US009044962B2

(12) United States Patent
Tomomatsu et al.

(10) Patent No.: US 9,044,962 B2
(45) Date of Patent: Jun. 2, 2015

(54) PRINTER, PRINTING PROCESSING METHOD, AND RECORDING MEDIUM

(71) Applicant: Brother Kogyo Kabushiki Kaisha, Nagoya-shi, Aichi-ken (JP)

(72) Inventors: Yoshitsugu Tomomatsu, Nagoya (JP); Koichi Kondo, Inuyama (JP); Keigo Kako, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/453,663

(22) Filed: Aug. 7, 2014

(65) Prior Publication Data

US 2015/0042741 A1 Feb. 12, 2015

(30) Foreign Application Priority Data

Aug. 8, 2013 (JP) ..... 2013-165374

(51) Int. Cl.

| | |
|---|---|
| ***B41J 11/00*** | (2006.01) |
| ***B41J 2/325*** | (2006.01) |
| ***B41J 2/00*** | (2006.01) |
| ***B41J 2/525*** | (2006.01) |

(52) U.S. Cl.

CPC . *B41J 2/325* (2013.01); *B41J 2/525* (2013.01)

(58) Field of Classification Search

USPC ..... 347/218, 188, 172

See application file for complete search history.

(56) References Cited

U.S. PATENT DOCUMENTS

| | | | | |
|---|---|---|---|---|
| 5,374,132 | A | | 12/1994 | Kimura |
| 5,725,318 | A | * | 3/1998 | Yamaguchi et al. ..... 400/120.02 |

FOREIGN PATENT DOCUMENTS

| | | | | |
|---|---|---|---|---|
| JP | H06-127094 | A | | 5/1994 |
| JP | H09-290536 | A | | 11/1997 |
| JP | 2012-073700 | A | | 4/2012 |
| JP | 2012-088936 | A | | 5/2012 |
| JP | 2012088936 | A | * | 5/2012 |

* cited by examiner

*Primary Examiner* — Sarah Al Hashimi

(74) *Attorney, Agent, or Firm* — Banner & Witcoff, Ltd.

(57) ABSTRACT

The disclosure discloses a printer including a first memory, a color detecting portion, a color identification information determining portion, and a transmitting portion. The first memory stores color correlations between a plurality of color types and a plurality of color identification information. The color detecting portion detects first color information of a print-receiving tape and second color information of an ink ribbon, of a tape cartridge mounted to a cartridge holder. The color identification information determining portion determines first color identification information of a color type corresponding to the first color information, and second color identification information of a color type corresponding to the second color information, by referring to color correlations. The transmitting portion transmits the first color identification information and the second color identification information to an operation terminal comprising substantially the same color correlations as the color correlations.

6 Claims, 11 Drawing Sheets

FIG. 5

COMPARISON EXAMPLE

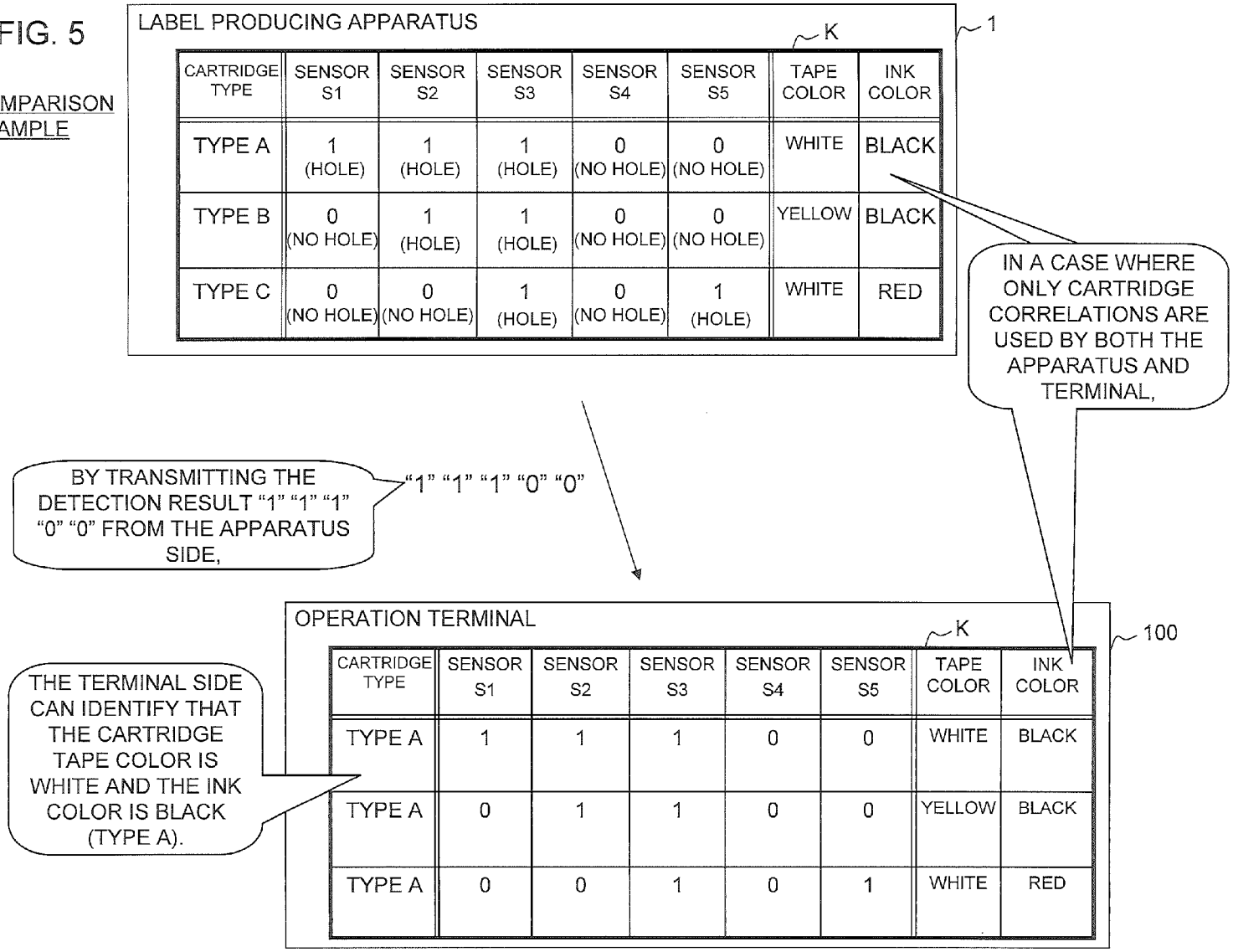

| CARTRIDGE TYPE | SENSOR S1 | SENSOR S2 | SENSOR S3 | SENSOR S4 | SENSOR S5 | TAPE COLOR | INK COLOR |
|---|---|---|---|---|---|---|---|
| TYPE A | 1 (HOLE) | 1 (HOLE) | 1 (HOLE) | 0 (NO HOLE) | 0 (NO HOLE) | WHITE | BLACK |
| TYPE B | 0 (NO HOLE) | 1 (HOLE) | 1 (HOLE) | 0 (NO HOLE) | 0 (NO HOLE) | YELLOW | BLACK |
| TYPE C | 0 (NO HOLE) | 0 (NO HOLE) | 1 (HOLE) | 0 (NO HOLE) | 1 (HOLE) | WHITE | RED |

| CARTRIDGE TYPE | SENSOR S1 | SENSOR S2 | SENSOR S3 | SENSOR S4 | SENSOR S5 | TAPE COLOR | INK COLOR |
|---|---|---|---|---|---|---|---|
| TYPE A | 1 | 1 | 1 | 0 | 0 | WHITE | BLACK |
| TYPE A | 0 | 1 | 1 | 0 | 0 | YELLOW | BLACK |
| TYPE A | 0 | 0 | 1 | 0 | 1 | WHITE | RED |

COMPARISON EXAMPLE

EMBODIMENT

EMBODIMENT

PRINTER, PRINTING PROCESSING METHOD, AND RECORDING MEDIUM

CROSS-REFERENCE TO RELATED APPLICATION

The present application claims priority from Japanese Patent Application No. 2013-165374, which was filed on Aug. 8, 2013, the disclosure of which is incorporated herein by reference in its entirety.

BACKGROUND

1. Field

The present disclosure relates to a printer that performs desired printing on a print-receiving tape based on an operation from an operation terminal, a printing processing method, and a recording medium that stores a program that executes the printing processing method.

2. Description of the Related Art

There are known printers that perform desired printing based on an operation from an operation terminal. The printer (label printer) of this prior art comprises a cartridge holder (cassette storage part) and a thermal head. When a tape cartridge (tape cassette) is mounted to the cartridge holder, the print-receiving tape is fed out from the print-receiving tape roll inside the tape cartridge. Then, the ink of an ink ribbon fed out from an ink ribbon roll inside the tape cartridge is transferred to the print-receiving tape by the thermal head, thereby forming desired print on the print-receiving tape and generating a printed matter (label). Such a print formation operation of the printer is performed according to an operation from the operation terminal (personal computer).

Hence, an operator can generate printed matter in various colors while variously changing the color combination of the print-receiving tape and ink ribbon by variously replacing and using the tape cartridges. That is, a cartridge sensor (cassette sensor) that detects the type of tape cartridge mounted to the cartridge holder is provided, and the detection result of the cartridge sensor (that is, the type information of the tape cartridge) is transmitted to the operation terminal. At this time, the associations (correlations) between the type information of the respective cartridges, and the combinations of the color information of the print-receiving tape and the color of the ink ribbon of the cartridge are stored in advance in the operation terminal for use. The operation terminal can acquire the color information of the print-receiving tape as well as the color information of the ink ribbon of the tape cartridge by referring to the stored correlations based on the received type information of the cartridge, and display the colors.

Nevertheless, according to the prior art, if a new type of tape cartridge (that is, a new combination of color information of the print-receiving tape and color information of the ink ribbon) not included in the correlations prepared in advance as described above is mounted to the cartridge holder, for example, the tape cartridge is not supported, resulting in an error and failure to perform the display. Thus, in order to avoid this, the prior art has the disadvantage that the operator must update the correlations on the operation terminal side to ensure tape cartridge support each time a new type of tape cartridge is to be used.

SUMMARY

It is therefore an object of the present disclosure to provide a printer, a printing processing method, and a recording medium that stores a program that executes the printing processing method, capable of readily supporting a tape cartridge with a new combination of a print-receiving tape color and an ink ribbon color without updating the correlations prepared in advance on the operation terminal side.

In order to achieve the above-described object, according to the aspect of the present application, there is provided a printer comprising a cartridge holder configured to attach and detach a tape cartridge comprising a print-receiving tape roll that feeds out a print-receiving tape and an ink ribbon roll that feeds out an ink ribbon, a thermal head configured to transfer ink of the ink ribbon fed out from the ink ribbon roll to and thus perform printing on the print-receiving tape fed out from the print-receiving tape roll of the tape cartridge mounted to the cartridge holder, a first memory configured to store color correlations between a plurality of color types and a plurality of color identification information respectively associated with the plurality of color types, set in advance, a color detecting portion configured to detect first color information of the print-receiving tape and second color information of the ink ribbon, of the tape cartridge mounted to the cartridge holder, a color identification information determining portion configured to determine first color identification information of a color type corresponding to the first color information detected by the color detecting portion, and second color identification information of a color type corresponding to the second color information detected by the color detecting portion, by referring to the color correlations stored in the first memory, and a transmitting portion configured to transmit the first color identification information and the second color identification information determined by the color identification information determining portion to an operation terminal for operating the printer, comprising substantially the same color correlations as the color correlations.

BRIEF DESCRIPTION OF THE DRAWINGS

FIG. 5 is an explanatory view showing the flow of the tape color information and ink color information in a comparison example.

DETAILED DESCRIPTION OF THE PREFERRED EMBODIMENTS

The following describes an embodiment of the present disclosure with reference to accompanying drawings. Note that, in the following descriptions, the terms "front," "rear," "left," "right," "up," and "down" of the label producing apparatus 1 respectively correspond to the arrow directions suitably shown in the respective figures, such as FIG. 1.

Overall Structure of Label Producing Apparatus

Figure 1:
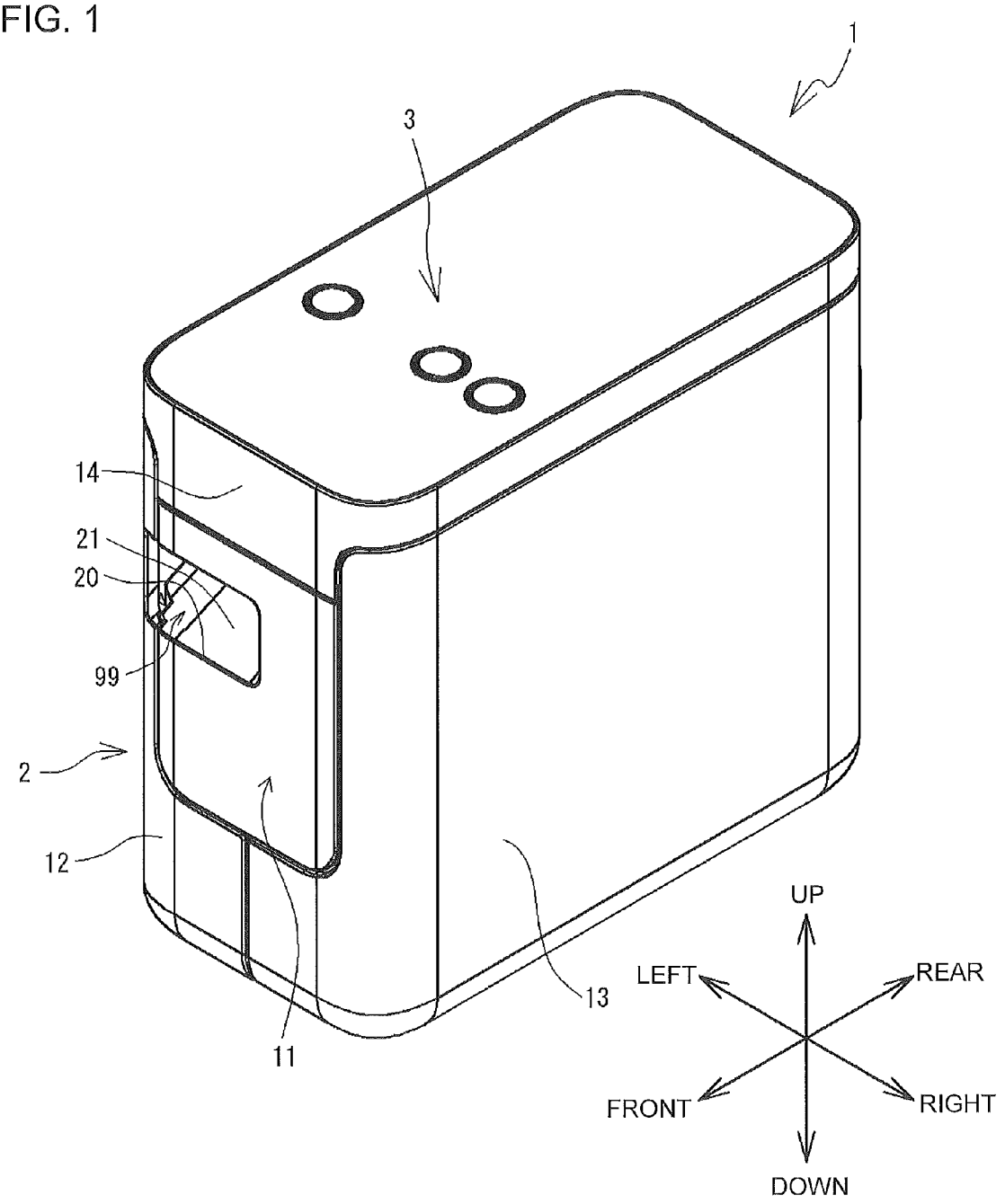
FIG. 1 is a perspective view showing a label producing apparatus of an embodiment of the present disclosure.

The label producing apparatus 1 shown in FIG. 1 is a general-purpose apparatus capable of producing a print label (printed matter) using various tape cartridges, such as a thermal type, receptor type, laminated type, and tube type, in a single unit. According to this embodiment, a receptor-type printer is described.

As shown in FIG. 1, the label producing apparatus 1 (printer) of this embodiment comprises a main body part 11 covered by a main body cover 2 with a substantially rectangular parallelepiped shape. The main body cover 2 comprises a left cover 12, a right cover 13, and an upper cover 14, respectively covering the leftward area, rightward area, and upward area of the main body part 11. The left cover 12 is mounted pivotally around an axis line in the front-rear direction to the lower left area of the main body part 11, and is disposed so that a cartridge holder 8 (refer to FIG. 2 described later) disposed in the left side surface area of the main body part 11 can be opened and closed. The right cover 13 is detachably mounted to the right side surface area of the main body part 11, and is disposed so that a battery storage part (not shown) disposed in the rightward area of the main body part 11 can be opened and closed.

An operation part 3 for operating the label producing apparatus 1 is disposed on the upper surface of the above described upper cover 14. The operation part 3 comprises buttons that perform various operations, such as a power button and a cutter button. A discharging part 99 comprising a slanted surface 21 connected to a label discharging exit 20 is disposed in the front area of the main body part 11. A print label (not shown) formed by the label producing apparatus 1 is introduced to the discharging exit 20 through the discharging part 99 and discharged to the outside of the label producing apparatus 1 from the discharging exit 20. A USB (Universal Serial Bus) jack and the like are disposed in the rear surface area of the main body part 11. The label producing apparatus 1 is connected to an operation terminal 100 (refer to FIG. 4 described later) of a personal computer or the like via a USB cable 107 (refer to FIG. 4 described later) connected to the USB jack. The label producing apparatus 1 performs desired printing on a print-receiving tape 57 (refer to FIG. 2 and FIG. 3 described later) based on print data such as characters, numbers, or graphics transmitted from the operation terminal 100. Note that the label producing apparatus 1 and the operation terminal 100 may be connected wirelessly.

Internal Structure of Apparatus

Figure 2:
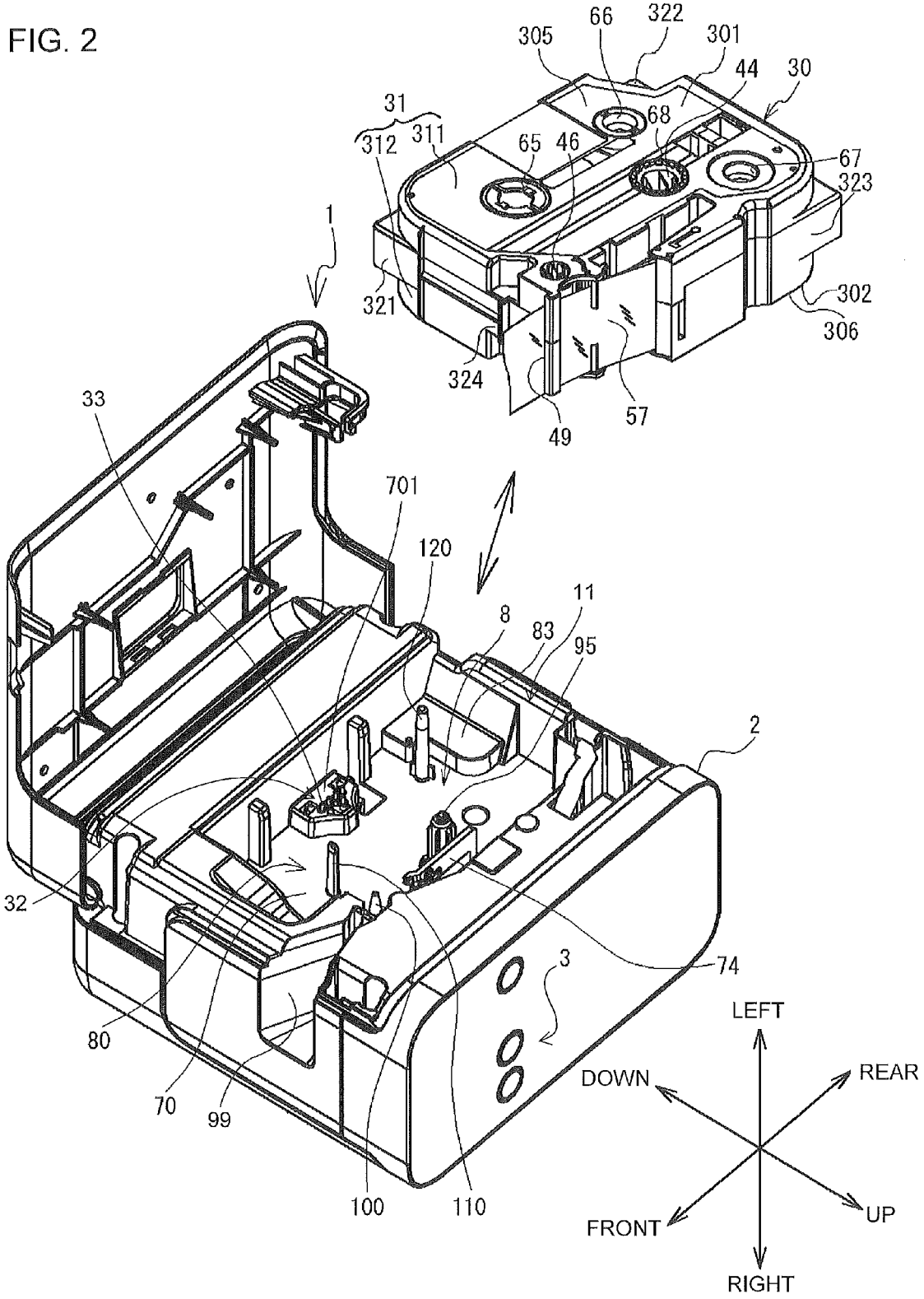
FIG. 2 is a perspective view showing the label producing apparatus and tape cartridge.
Figure 3:
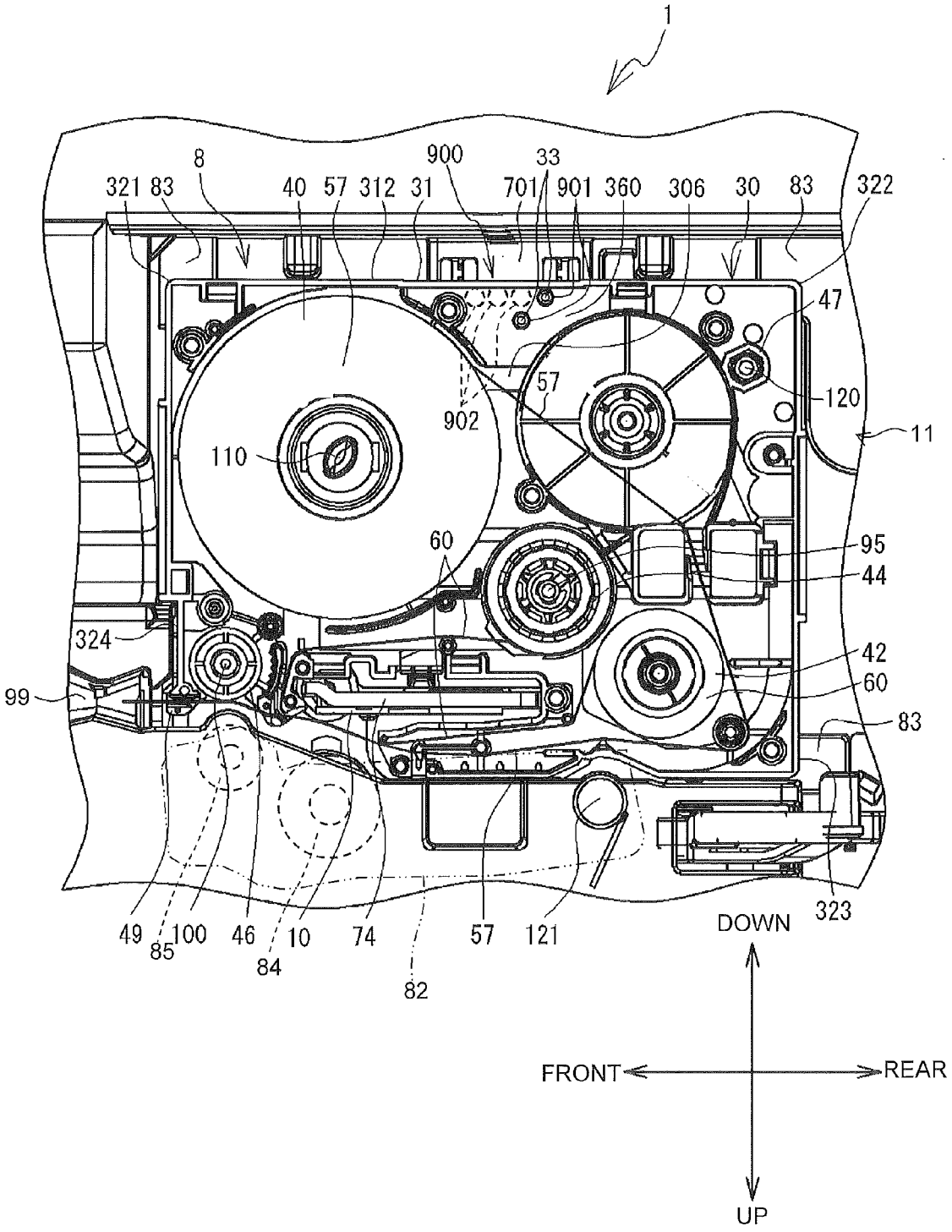
FIG. 3 is a plan view showing the area near a cartridge holder to which a tape cartridge of the label producing apparatus is mounted.

The following describes the internal structure of the label producing apparatus 1. As shown in FIG. 2 and FIG. 3, the above described cartridge holder 8 capable of attaching and detaching the tape cartridge 30 is disposed in the left side surface area of the main body part 11. The cartridge holder 8 is formed so as to include a cavity 80, corner support surfaces 83, a concave part 70, and a downward support surface 701. The cavity 80 is a concave area recessed so as to substantially correspond to the shape of a bottom surface 302 of a cassette case 31. The corner support surfaces 83 are disposed in the rear side lower area, front side lower area, and rear side upper area of the cartridge holder 8. The downward support surface 701 is disposed on the front-rear direction center of the lower area of the cartridge holder 8. The corner support surfaces 83 and the downward support surface 701 are planes that horizontally extend from an outer edge of the cavity 80. If the tape cartridge 30 is mounted to the cartridge holder 8, the corner support surfaces 83 support the lower surfaces of the corner areas of the tape cartridge 30, and the downward support surface 701 supports a downward recessed wall 360 (refer to FIG. 3) of the tape cartridge 30.

A head holder 74 made of a plate-shaped member that extends in the front-rear direction stands in a position near the upper area of the front-rear direction substantial center area of the cartridge holder 8. A thermal head 10 comprising a heating body (not shown) is disposed on the upper side surface of the head holder 74. A ribbon take-up shaft 95 stands in the rearward area of the head holder 74. The ribbon take-up shaft 95 is a shaft body detachable from a ribbon take-up roller 44 of the tape cartridge 30. A tape driving shaft 100 stands in the rearward area of the head holder 74. The tape driving shaft 100 is a shaft body detachable from a feeding roller 46 of the tape cartridge 30. An auxiliary shaft 110 stands in the lower side rearward area of the tape driving shaft 100. The auxiliary shaft 110 is a shaft body detachable from a print-receiving tape roll 40 of the tape cartridge 30. A guide shaft 120 stands in a position near the corner area in the lower side rearward area of the cartridge holder 8. The guide shaft 120 is a shaft body detachable from a guide hole 47 of the tape cartridge 30.

A drive motor 63 (refer to FIG. 4 described later), which is a stepping motor, is disposed on the right side of the cartridge holder 8 of the main body part 11. The ribbon take-up roller 44 (ribbon take-up shaft 95), the feeding roller 46 (tape driving shaft 100), and a platen roller 84 described later are connected to the drive motor 63 via a plurality of gears (not shown). The ribbon take-up roller 44, the feeding roller 46, and the platen roller 84 rotate in accordance with the driving of the drive motor 63.

Further, a cartridge sensor 32, from which stand a plurality of (five in this example) pressed sensor protrusions 33, is disposed on the above described downward support surface 701 of the front-rear direction substantial center of the lower area of the above described cartridge holder 8. When the tape cartridge 30 is mounted to the cartridge holder 8, a detected portion 900 disposed on the tape cartridge 30 faces the sensor protrusions 33, and the sensor protrusions 33 corresponding to the combination of the tape color of the print-receiving tape 57 and the ink color of an ink ribbon 60 in accordance with the type of the tape cartridge 30 are selectively pressed by the detected portion 900. The cartridge sensor 32 outputs a detection signal that indicates the type information (tape color and ink color) of the tape cartridge 30, based on the on/off combination of the sensor protrusions 33 at the time.

An arm-shaped platen holder 82 that extends in the front-rear direction is disposed in the upper side outward area of the cartridge holder 8 of the main body part 11. The platen holder 82 is rockably supported about a shaft support part 121. The above described platen roller 84 and a pressure roller 85 are rotatably supported in the left end area of the platen holder 82. The platen roller 84 faces the thermal head 10, and is capable of coming in contact with and moving away from the thermal head 10. The pressure roller 85 faces the feeding roller 46, and is capable of coming in contact with and moving away from the feeding roller 46. When the left cover 12 is closed, the platen holder 82 moves in the direction of the cartridge holder 8 by a cam mechanism (not shown), and the platen roller 84 disposed on the platen holder 82 moves to a print position that contacts the thermal head 10. In the print position, the platen roller 84 presses against the thermal head 10 via the print-receiving tape 57 and the ink ribbon 60. Simultaneously, the pressure roller 85 presses against the feeding roller 46 via the print-receiving tape 57. In this state, the print-receiving tape 57 and the ink ribbon 60 inside the tape cartridge 30 are fed with the rotation of the ribbon take-up roller 44, the feeding roller 46, the platen roller 84, and the pressure roller 85, and the ink of the ink ribbon 60 is transferred by the thermal head 10, thereby performing printing on the print-receiving tape 57.

A label cutter mechanism (not shown) is disposed between the discharging part 99 and the feeding roller 46 of the main body part 11. The label cutter mechanism comprises a fixed blade and a movable blade and, when a cutter button of the operation part 3 is pressed, the movable blade advances toward the fixed blade, cuts the print-receiving tape 57 with print, and generates a print label (not shown).

Cartridge Structure

The following describes the structure of the tape cartridge 30. As shown in FIG. 2 and FIG. 3, the tape cartridge 30 comprises the case 31 that has an overall substantially rectangular parallelepiped shape (box type) comprising rounded corner areas in a planar view. The case 31 includes a first case 311 (upper side in FIG. 2) and a second case 312 (lower side in FIG. 2). The first case 311 includes a left side plate 305 that forms a left side surface 301 of the case 31, and is fixed to the area surrounding the opening of the second case 312. The second case 312 includes a bottom plate 306 that forms the bottom surface 302 of the case 31.

The case 31 comprises four corner parts 321-324 formed to the same width (the same length in the up-down direction in FIG. 2). That is, the four corner parts are the first corner part 321 in the front-side downward area, the second corner part 322 in the rear-side downward area, the third corner part 323 in the rear-side upward area, and the fourth corner part 324 in the front-side upward area of the case 31. The first to third corner parts 321-323 protrude from the side surface of the case 31 toward the outside, forming right angles in the planar view. The fourth corner part 324 does not form a right angle since a discharging guide part 49 that guides the tape discharged from the tape cartridge 30 is disposed on the corner. The corner parts 321-323 are areas supported by ribs (not shown) disposed on the corner support surfaces 83 disposed on the cartridge holder 8 when the tape cartridge 30 is mounted to the cartridge holder 8.

Four support holes 65-68 for rotatably supporting rolls and the like comprised by the case 31 are disposed on the case 31. That is, the four support holes are the tape roll support hole 65 of the front side lower area, the cover film roll support hole 66 of the rear side lower area, the ribbon roll support hole 67 of the rear side upper area, and the ribbon take-up roll support hole 68 between the tape roll support hole 65 and the ribbon roll support hole 67 of the case 31.

The tape roll support hole 65 rotatably supports the print-receiving tape roll 40 around which is wound the print-receiving tape 57. The print-receiving tape 57 is pulled out from the print-receiving tape roll 40 on the tape roll support hole 65 and, after print formation is performed using the ink ribbon 60 by the thermal head 10, guided toward the discharging part 99. The support hole 67 rotatably supports an ink ribbon roll 42 around which is wound the ink ribbon 60. The ink ribbon 60 is pulled out from the ink ribbon roll 42, superimposed with the print-receiving tape 57 pulled out from the print-receiving tape roll 40, and used for print formation by the thermal head 10. The ribbon take-up roll support hole 68 rotatably supports the ribbon take-up roller 44. The ribbon take-up roller 44 takes up the ink ribbon 60 after use for printing. Note that if the cartridge 8 uses a laminated-type cover film as the print-receiving tape, for example, the cover film roll (not shown) around which is wound the cover film is rotatably supported by the cover film roll support hole 66.

The downward recessed wall 360 is disposed in the substantial center position in the front-rear direction of the lower area of the case 31. The downward recessed wall 360 is a wall part that forms a recessed area wherein a portion of the bottom plate 306 is recessed further leftward than the bottom surface 302 (toward the viewer of FIG. 3), and comprises a shape that substantially corresponds to the downward support surface 701 of the cartridge holder 8. The detected portion 900 that indicates the type information of the tape cartridge 30 is disposed on the downward recessed wall 360.

The detected portion 900 indicates the type information of the tape cartridge 30 by the combination of hole parts 901 (non-pressing parts) and surface parts 902 (pressing parts) formed on the downward recessed wall 360, facing the five sensor protrusions 33 of the cartridge sensor 32 disposed on the apparatus main body 11. According to this embodiment, the detected portion 900 regulates the type information of the tape cartridge, including the tape color information of the material of the print-receiving tape 57 (first color information) and the ink color information of the ink ribbon 60 (second color information) of the tape cartridge 30.

The hole part 901 is a circular hole part and functions as a non-pressing part that is not pressed by the sensor protrusion 33 if the tape cartridge 30 is mounted to the cartridge holder 8, causing the sensor protrusion 33 that faces the hole part 901 to be in an OFF state. The surface part 902 functions as a pressing part that presses against the sensor protrusion 33 if the tape cartridge 30 is mounted to the cartridge holder 8, causing the sensor protrusion 33 that faces the surface part 902 to be in an ON state.

Control System of Printer and Operation Terminal

Next, the control system of the label producing apparatus 1 and the operation terminal 100 will be described with reference to FIG. 4.

Figure 4:
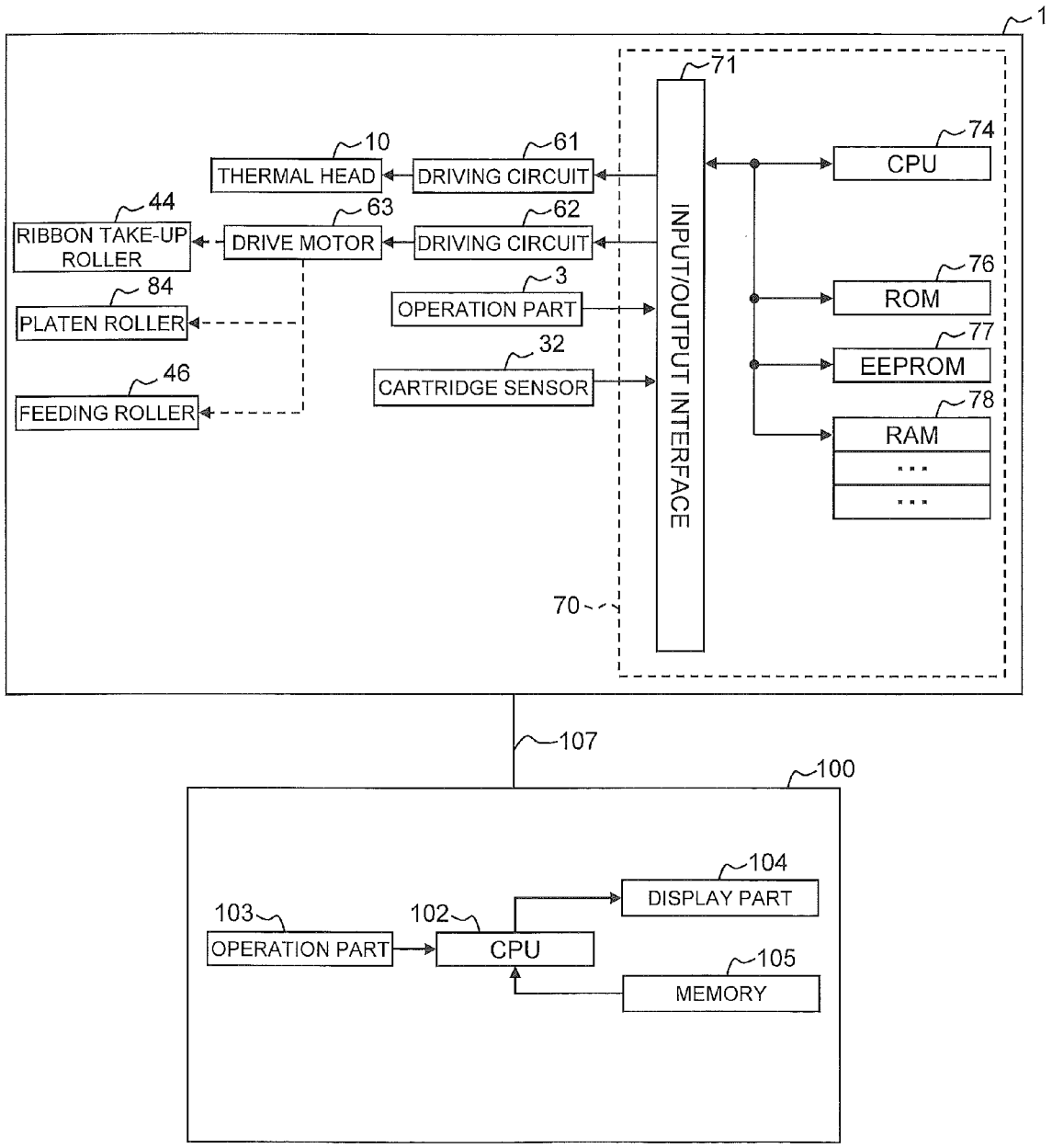
FIG. 4 is a functional block diagram showing the functional configuration of the label producing apparatus and operation terminal.
Figure 6:
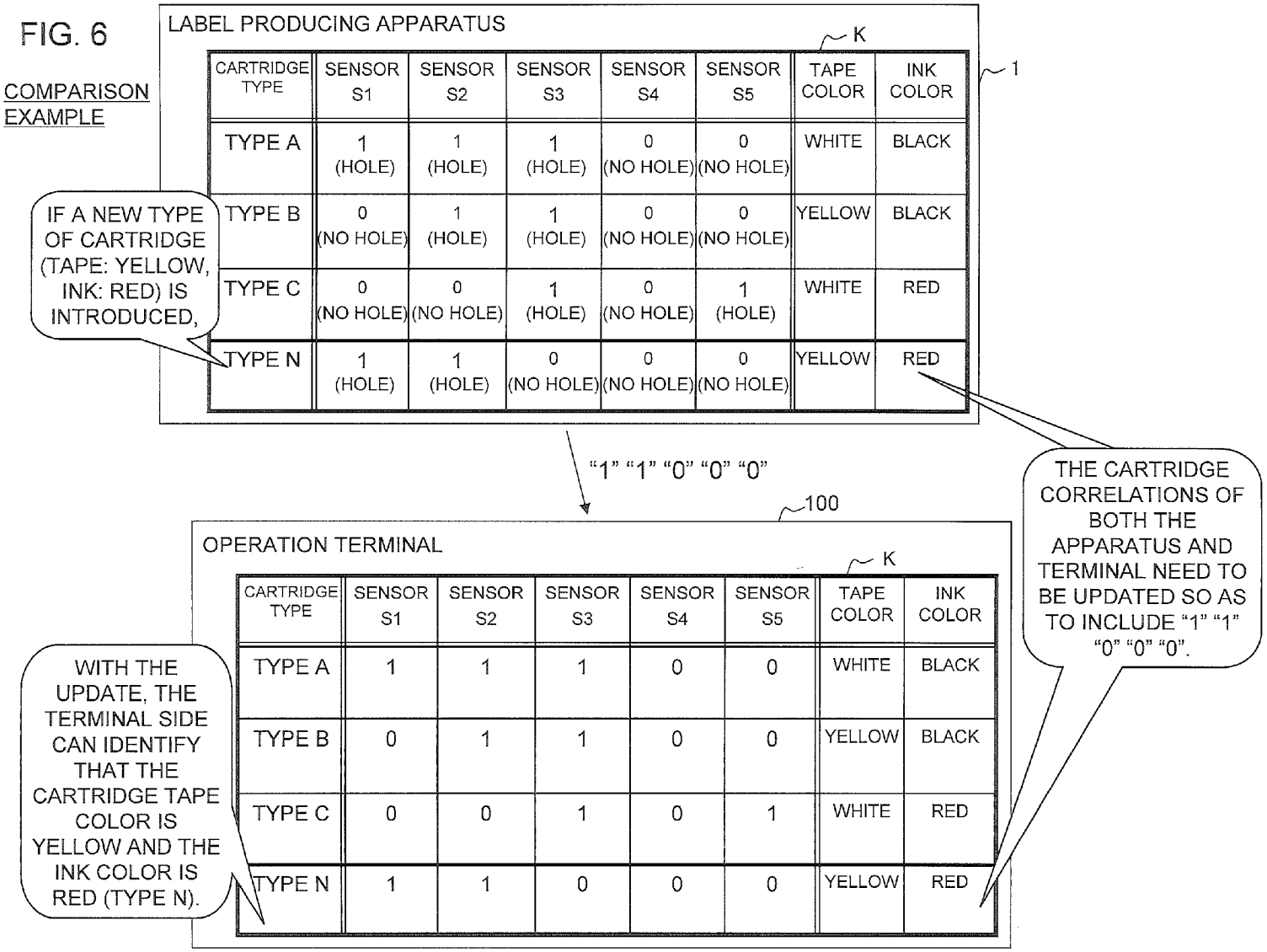
FIG. 6 is an explanatory view explaining a case where a new type of cartridge is used in a comparison example.

The label producing apparatus 1 comprises a control system comprising the control circuit 70 that includes the CPU 74, as shown in FIG. 4. On the control circuit 70, a ROM 76 (recording medium), a RAM 78, an EEPROM 77, and an input/output interface 71 are connected to the CPU 74 via a data bus. Note that nonvolatile memory such as flash memory may be used in place of the EEPROM 77.

Various programs (such as a control program that executes the respective procedures of the flows of FIG. 9A, FIG. 10A, and FIG. 11A described later, for example) required for controlling the print label producing apparatus 1 are stored in the ROM 76. The CPU 74 performs various operations based on the various programs stored in this ROM 76.

The RAM 78 temporarily stores various operation results from the CPU 74.

Color correlations S (refer to FIG. 7 and FIG. 8 described later) between a plurality of color types and a plurality of color identification information (color IDs) respectively associated with the plurality of color types are stored in the EEPROM 77 in relation to the color information of the print-receiving tape 57. Further, cartridge correlations K (refer to FIG. 5, FIG. 6, FIG. 7, and FIG. 8 described later) that associate the type information of the tape cartridge 30, and the combination of the tape color of the print-receiving tape 57 (the above described first color information) and the ink color of the ink ribbon 60 (the above described second color information) of the tape cartridge 30 are stored in the EEPROM 77. Note that, due to the above described functions, the EEPROM 77 functions as a first memory as well as a second memory in the respective claims.

The above described operation part 3, a thermal head driving circuit 61, a motor driving circuit 62, the above described cartridge sensor 32, and the like are connected to the input/output interface 71.

The thermal head driving circuit 61 controls the driving of the above described thermal head 10.

The motor driving circuit 62 controls the driving of the driving motor 63, thereby rotating the above described ink ribbon take-up roller 44 via a gear (not shown). Further, the rotation of the gear is transmitted to a platen roller gear and feeding roller gear (not shown), thereby rotating the above described platen roller 84 and the feeding roller 46.

The operation terminal 100 comprises a control system comprising a CPU 102, as shown in FIG. 4. An operation part 103, a display part 104, a memory 105, and the like are connected to the CPU 102.

The operation terminal 100 is connected to the label producing apparatus 1 via the USB cable 107 and the like, and disposed so that signals can be transmitted and received with the label producing apparatus 1.

According to the operation terminal 100, the operator can operate the operation part 103 to create print data for forming print on a print label to be produced by the label producing apparatus 1 and transmit the created print data to the label producing apparatus 1. That is, when a predetermined label production instruction that includes the above described print data is output to the label producing apparatus by an operation of the operation part 103 by the operator, the platen roller 84, the feeding roller 46, and the like are driven via the motor driving circuit 62 and the driving motor 63 in the label producing apparatus 1, thereby feeding the print-receiving tape 57 out from the print-receiving tape roll 40. Further, in synchronization therewith, a plurality of heating elements of the thermal head 10 is selectively heated and driven via the thermal head driving circuit 61, thereby transferring the ink of the ink ribbon 60 fed out from the ink ribbon roll 42 to the above described fed out and fed print-receiving tape 57 and performing printing based on the print data on the print-receiving tape 57. Subsequently, the print-receiving tape 57 on which print has been formed is cut by a label cutter mechanism (not shown), thereby generating a print label with desired print.

At this time, the operator can generate print labels in various colors while variously changing the color combination of the print-receiving tape 57 and the ink ribbon 60 by variously replacing and using the tape cartridge 30. Thus, in this embodiment, the cartridge sensor 32 is disposed and, when the tape cartridge 30 is mounted to the cartridge holder 8, the type information of the tape cartridge 30 is acquired in accordance with the detection result from the cartridge sensor 32. Then, the information (details described later) corresponding to the acquired type information of the tape cartridge 30 is transmitted from the label producing apparatus 1 to the operation terminal 100. With this arrangement, the tape color of the print-receiving tape 57 (first color information) and the ink color of the ink ribbon 60 (second color information) are acquired on the operation terminal 100 side, based on the information transmitted. As a result, the operation terminal 100 can display the color of the print-receiving tape 57 and the color of the ink ribbon 60 (in other words, the color of the print to be formed) of the currently mounted tape cartridge 30 on an edit screen or the like, for example, of the display part 104 prior to print label production, thereby making the operator aware of the colors in advance.

Special Characteristics of this Embodiment

The special characteristics of this embodiment lie in the fact that the combination of the above described tape color (first color information) and the above described ink color (second color information) acquired based on the detection result of the cartridge sensor 32 when the tape cartridge 30 is mounted is not transmitted to the operation terminal 100 as is, but rather transmitted to the operation terminal 100 in a color identification information (details described later) converted form. In the following, details on the functions will be described in order.

Details of Detection Function of Cartridge Sensor

In the above described cartridge sensor 32, a plurality of (five in this example) pressed sensor protrusions 33 (indicated by sensor protrusions S1, S2, S3, S4, S5 in order to distinguish the five in FIG. 5 described later) is formed on the downward support surface 701 of the cartridge holder 8. Then, the detected portion 900 comprising the hole parts 901 and the surface parts 902 is correspondingly disposed in at least one location of the downward recessed wall 360 of the cartridge 30, with the locations where the above described hole parts 901 are not disposed forming the surface parts 902 in a so-called wall surface state (no holes). When the tape cartridge 30 is mounted to the cartridge holder 8, any of the sensor protrusions S1-S5 is inserted into a location where the above described hole part 901 is disposed (without the protrusion being pressed), causing a corresponding signal "1" to be output from the sensor protrusion S1-S5 and input to the CPU 74. Further, any of the sensor protrusions S1-S5 is pressed due to contact in a location of the above described surface part 902 where the above described hole part (hole) is not disposed, causing a corresponding signal "0" to be output from the sensor protrusion S1-S5 and input to the CPU 74.

The type information of the tape cartridge 30 is acquired according to the combination pattern of the above described signals "0" or "1" from these sensor protrusions S1-S5. At this time, the type information of the above described tape cartridge 30, and the combination of the tape color information of the above described cover film 57 (first color information) and the ink color information of the above described ink ribbon 60 (second color information) comprised by the tape cartridge 30 are associated and stored as the cartridge correlations K in the above described EEPROM 77.

Comparison Example

As a comparison example of this embodiment, the following describes a technique wherein the combination of the above described tape color information (first color information) and the above described ink color information (second color information) is transmitted to the operation terminal 100 as is, using FIG. 5. As shown in FIG. 5, in this comparison example, in a case of a type A of the tape cartridge 30 in which the detection signals of the sensor protrusions S1, S2, S3 are "1" (hole) and the detection signals of the sensor protrusions S4, S5 are "0" (no hole), for example, the CPU 74 acquires the tape color information "white" of the print-receiving tape 57 and the ink color information "black" of the ink ribbon 60 by referring to the cartridge correlations K.

Similarly, in a case of a type B of the tape cartridge 30 in which the detection signals of the sensor protrusions S2, S3 are "1" (hole) and the detection signals of the sensor protrusions S1, S4, S5 are "0" (no hole), the CPU 74 acquires the above described tape color information "yellow" and the above described ink color information "black" by referring to the cartridge correlations K.

Further, similarly, in a case of a type C of the tape cartridge 30 in which the detection signals of the sensor protrusions S3, S5 are "1" (hole) and the detection signals of the sensor protrusions S1, S2, S4 are "0" (no hole), the CPU 74 acquires the above described tape color information "white" and the above described ink color information "red" by referring to the cartridge correlations K.

As understood from the above, the detection signal made of the combination of the numbers "1" and "0" of the above described sensor protrusions S1-S5 serves as information substantially equivalent to the combination of the tape color information (first color information) and ink color information (second color information) by using the cartridge correlations K.

Then, in a case where the cartridge type A of the tape cartridge 30, for example, is mounted to the cartridge holder 8 of the label producing apparatus 1, the label producing apparatus 1 transmits the detection signals "1" "1" "1" "0" "0 " of the corresponding above described sensor protrusions S1-S5 to the operation terminal 100.

At this time, in this comparison example, the same cartridge correlations K are also stored in the above described memory 105 of the operation terminal 100. As a result, in the operation terminal 100 that received the above described detection signals "1" "1" "1" "0" "0 ," the CPU 102 identifies the tape color information "white" of the print-receiving tape 57 and the ink color information "black" of the ink ribbon 60 of the tape cartridge 30 by referring to the cartridge correlations K of the above described memory 105, and performs a corresponding display on the display part 104.

Similarly, in a case where the tape cartridge 30 is the cartridge type B, the above described detection signals "0" "1" "1" "0" "0 " are received by the operation terminal 100, the tape color information "yellow" and the ink color information "black" of the tape cartridge 30 are identified based on the cartridge correlations K and a corresponding display is performed on the display part 104.

Similarly, in a case where the tape cartridge 30 is the cartridge type C, the above described detection signals "0" "0" "1" "0" "1 " are received by the operation terminal 100, the tape color information "white" and the ink color information "red" of the tape cartridge 30 are identified based on the cartridge correlations K and a corresponding display is performed on the display part 104.

Problems in Comparison Example

As described above, the cartridge correlations K are used with both the label producing apparatus 1 and the operation terminal 100 in the above described comparison example. Nevertheless, in this case, if a new type of tape cartridge 30 (that is, a new combination of the tape color of the print-receiving tape 57 and the ink color of the ink ribbon 60) not included in the cartridge correlations K prepared in advance as described above is mounted to the cartridge holder 8, for example, the tape cartridge 30 is not supported, resulting in an error and failure to perform the above described display.

To avoid this, the cartridge correlations K of the label producing apparatus 1 and the cartridge correlations K of the operation terminal 100 must both be updated to ensure support of the tape cartridge 30 each time a new type of the tape cartridge 30 is used. The example shown in FIG. 6, for example, is of a case where a new type N of the tape cartridge 30 with a yellow tape color and a red ink color is used. In this case, the cartridge correlations K of both the label producing apparatus 1 and the operation terminal 100 are updated to the new cartridge correlations K in which the association between the detection signals "0" "0" "1" "0" "1 " when the type N of the tape cartridge 30 is mounted, and the tape color information "yellow" and the ink color information "red" has been newly increased.

Technique of Embodiment

In this embodiment, the detection signals (in other words, the combination information of the first color information and the second color information) detected when one tape cartridge 30 is mounted as described above are not transmitted to the operation terminal 100 (as is), but rather transmitted to the operation terminal 100 in a color identification information (described later) converted form. The following describes the details thereof using FIG. 7 and FIG. 8.

Figure 7:
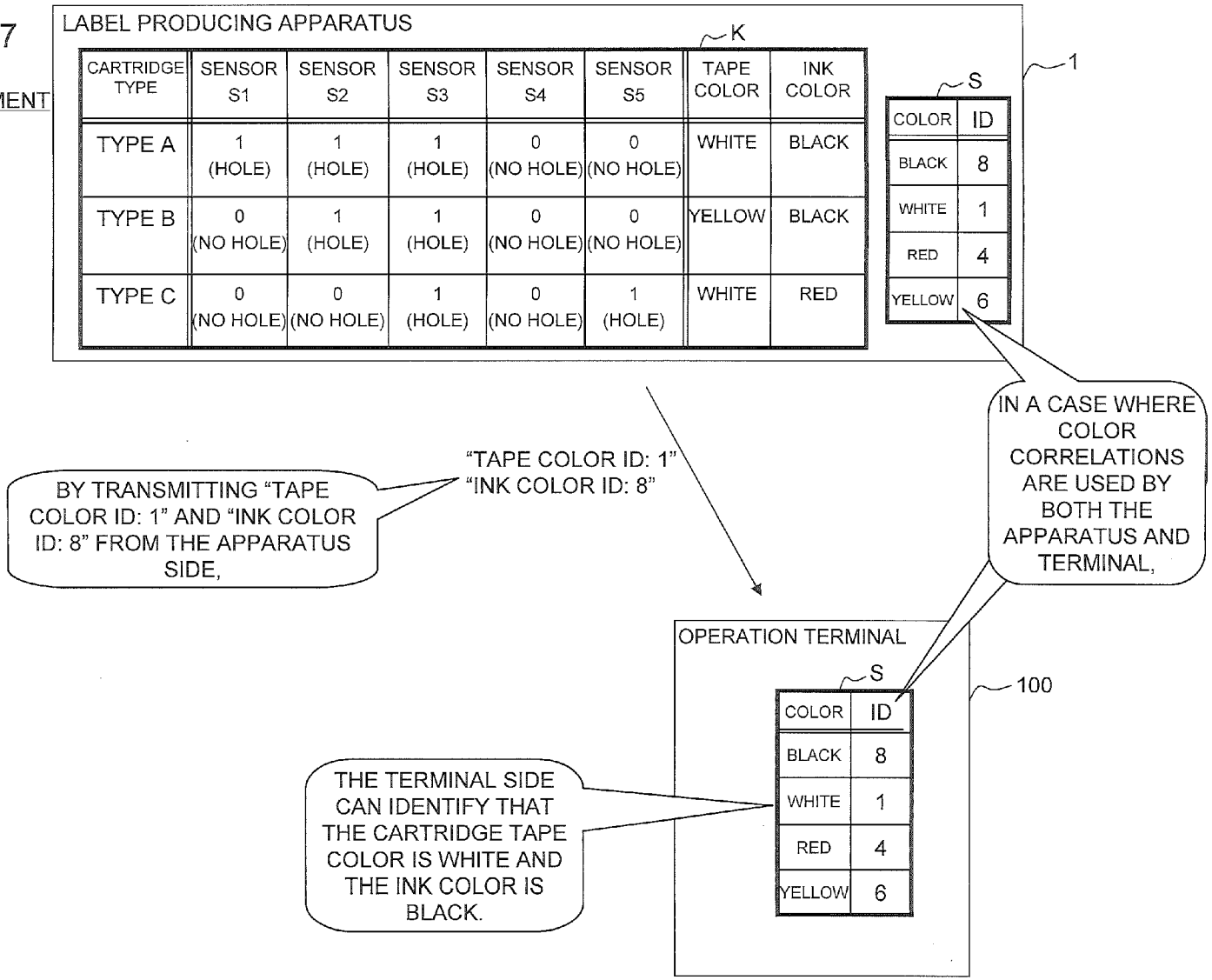
FIG. 7 is an explanatory view showing the flow of tape color IDs and ink color IDs corresponding to the tape color information and ink color information in the embodiment.

As shown in FIG. 7, according to the label producing apparatus 1 of this embodiment, the predetermined color correlations S are stored in advance in the EEPROM 77 in addition to the same cartridge correlations K as described above. According to the color correlations S, a plurality of color types and a plurality of color identification information (color IDs) set in advance are mutually associated. That is, as shown in FIG. 7, the color types of a plurality of colors (the four colors "black" "white" "red" "yellow" in this example) and a plurality of color identification information (the four IDs "8" "1" "4" "6 " in this example) set in advance are mutually associated.

Then, according to the label producing apparatus 1, the first color identification information that serves as the color type corresponding to the first color information detected as previously described, and the second color identification information that serves as the color type corresponding to the above described detected second color information are determined by referring to the color correlations S stored in the EEPROM 77. Then, the first color identification information and the second color identification information are transmitted to the operation terminal 100. That is, in a case of the type A of the tape cartridge 30 in which the detection signals of the sensor protrusions S1, S2, S3 are "1" (hole) and the detection signals of the sensor protrusions S4, S5 are "0" (no hole), for example, the CPU 74 acquires the tape color information "white" of the print-receiving tape 57 as the above described first color information and the ink color information "black" of the ink ribbon 60 as the above described second color information by referring to the cartridge correlations K in the same manner as previously mentioned. Then, the CPU 74 applies the above described color correlations S to the acquired "white" "black," thereby acquiring the tape color ID: 1 which is the above described first color identification information, and the ink color ID: 8 which is the above described second color identification information. The label producing apparatus 1 transmits the two acquired IDs to the operation terminal 100.

At this time, the same color correlations S as described above are also stored in the above described memory 105 of the operation terminal 100. The operation terminal 100 that receives the above described first color identification information and the second color identification information can acquire the above described first color information corresponding to the received first color identification information and the second color information corresponding to the received second color identification information by referring to the color correlations S stored in the above described memory 105. For example, when the tape color ID: 1 and the ink color ID: 8 transmitted as described above are received, according to the operation terminal 100, the CPU 102 identifies the tape color information "white" of the print-receiving tape 57 and the ink color information "black" of the ink ribbon 60 by referring to the color correlations S. As a result, the operation terminal 100 can display the color of the print-receiving tape 57 and the color of the ink ribbon 60 (in other words, the color of the print to be formed) of the currently mounted tape cartridge 30 on an edit screen or the like displayed on the display part 104, for example, prior to printed matter production, thereby making the operator aware of the colors in advance.

Similarly, in a case where the tape cartridge is type B wherein the detection signals of the above described sensor protrusions S1, S2, S3, S4, S5 are "0" "1" "1" "0" "0 ," the tape color information "yellow" and the ink color information "black" are acquired based on the cartridge correlations K. Then, reference is made to the color correlations S to acquire the corresponding tape color ID: 6 and ink color ID: 8. Then, the two IDs are transmitted from the label producing apparatus 1 and, in the operation terminal 100 that receives these, the CPU 102 identifies the corresponding tape color information "yellow" and ink color information "black" by referring to the color correlations S, and displays the colors in the same manner as described above.

Similarly, in a case where the tape cartridge is type C wherein the detection signals of the above described sensor protrusions S1, S2, S3, S4, S5 are "0" "0" "1" "0" "1 ," the tape color information "white" and the ink color information "red" are acquired based on the cartridge correlations K. Then, reference is made to the color correlations S to acquire the corresponding tape color ID: 1 and ink color ID: 4. Then, the two IDs are transmitted from the label producing apparatus 1 and, in the operation terminal 100 that receives these, the CPU 102 identifies the corresponding tape color information "white" and ink color information "red" by referring to the color correlations S, and displays the colors in the same manner as described above.

Figure 8:
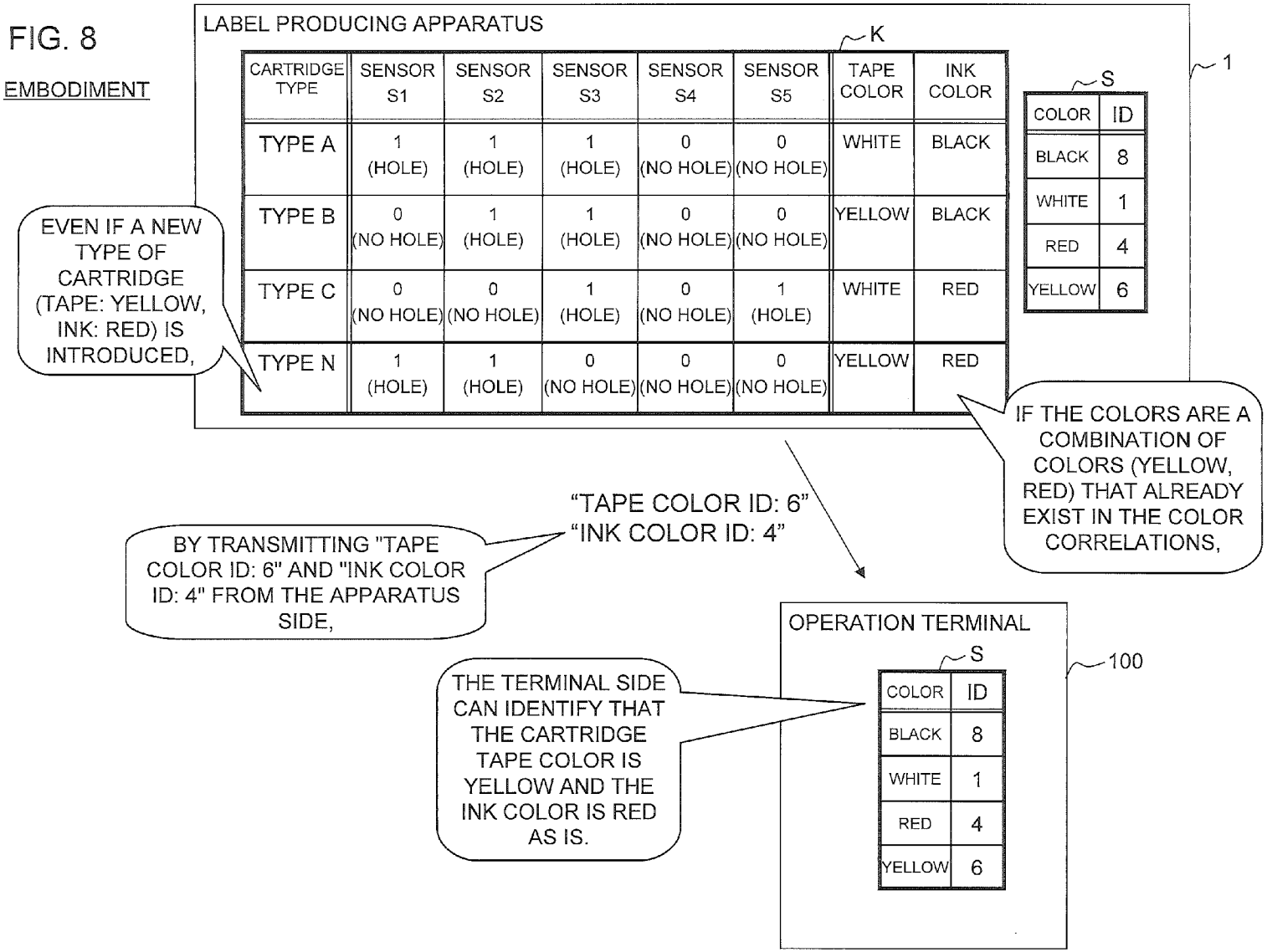
FIG. 8 is an explanatory view explaining a case where a new type of cartridge is used in the embodiment.

Then, according to such a technique of the embodiment, for example, as shown in FIG. 8, even in a case where the new type N of the tape cartridge 30 is newly used, it is only necessary to update the cartridge correlations K of the label producing apparatus 1 so as to include the detection signals "1" "1" "0" "0" "0 " when the new type N of the tape cartridge 30 is mounted if the above described tape color and the above described ink color of the tape cartridge 30 is a combination (the tape color is yellow and the ink color is red in this example) that already exists in the color correlations S.

That is, in the case described above, according to the label producing apparatus 1, the CPU 74 refers to the above described new cartridge correlations K (refer to FIG. 8) in response to the corresponding detection signals "1" "1" "0" "0" "0 " to acquire the tape color information "yellow" and the ink color information "red" when the above described new type N of the tape cartridge 30 is mounted. Then, reference is made to the color correlations S to acquire the corresponding tape color ID: 6 and ink color ID: 4. Then, the two IDs are transmitted from the label producing apparatus 1 and, in the operation terminal 100 that receives these, the CPU 74 identifies the corresponding tape color information "yellow" and ink color information "red" by referring to the color correlations S, and displays the colors in the same manner as described above.

Control Procedure

Figure 9A:
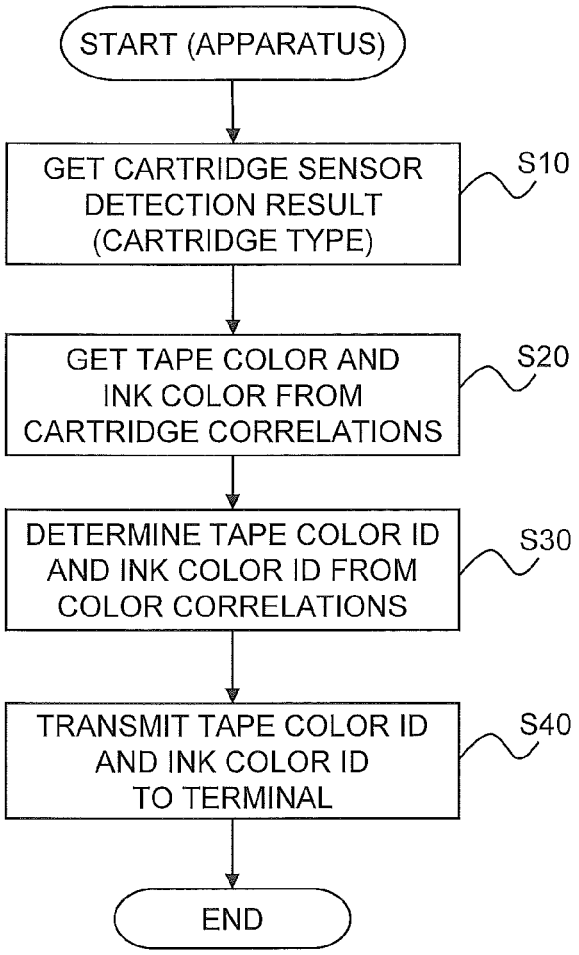
FIG. 9A is a flowchart showing the control procedure executed by the CPU of the label producing apparatus
Figure 9B:
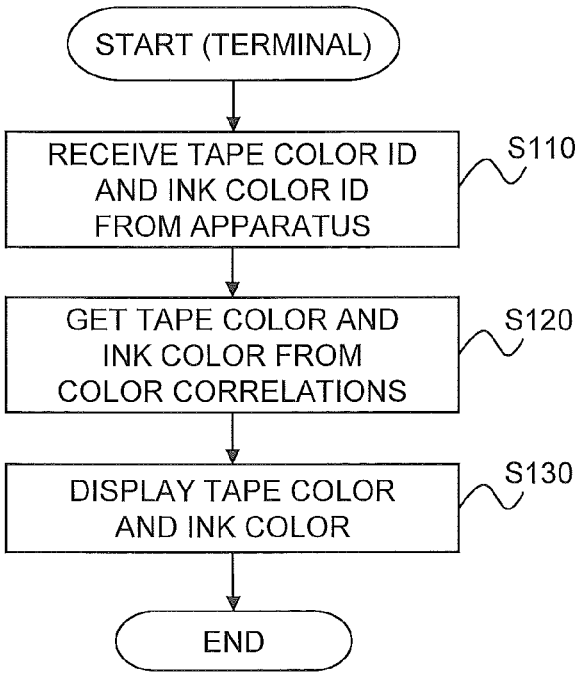
FIG. 9B is a flowchart showing the control procedure executed by the CPU of the operation terminal.

FIG. 9A and FIG. 9B respectively show the control procedures executed by the CPU 74 of the label producing apparatus 1 and the CPU 102 of the operation terminal 100 in order to achieve the above described technique.

Control Procedure of Label Producing Apparatus

First, the control procedure executed by the CPU 74 of the label producing apparatus 1 will be described using FIG. 9A. In FIG. 9A, first, in step S10, the CPU 74 acquires the detection result (the detection signals of the sensor protrusions S1, S2, S3, S4, S5 in the aforementioned example; in other words, the type of the tape cartridge 30) by the above described cartridge sensor 32 for the tape cartridge 30 mounted to the cartridge holder 8.

Subsequently, in step S20, the CPU 74 applies the above described cartridge correlations K stored in the EEPROM 77 to the detection result acquired in the above described step S10 to acquire the corresponding tape color information and ink color information. The CPU 74 that executes this step S20 functions as the color information acquiring portion described in the claims. Further, the CPU 74 that executes this step S20 and the cartridge sensor 32 function as the color detecting portion described in the claims. When step S20 ends, the flow proceeds to step S30.

In step S30, the CPU 74 applies the above described color correlations S (refer to FIG. 7) stored in the EEPROM 77 to determine the corresponding tape color ID and ink color ID, based on the tape color information and ink color information acquired in the above described step S20. The CPU 74 that executes this step S30 functions as the color identification information determining portion described in the claims. When step S30 ends, the flow proceeds to step S40.

In step S40, the CPU 74 transmits the tape color ID and ink color ID determined in the above described step S30 to the operation terminal 100. The CPU 74 that executes this step S40 functions as the transmitting portion described in the claims. This process then terminates here.

Control Procedure of Operation Terminal

The control procedure executed by the CPU 102 of the operation terminal 100 will now be described using FIG. 9B. In FIG. 9B, first, in step S110, the CPU 102 receives the tape color ID and ink color ID transmitted from the label producing apparatus 1 in the above described step S40.

Subsequently, in step S120, the CPU 102 applies the aforementioned color correlations S (refer to FIG. 7) stored in the memory 105 to the tape color ID and ink color ID received in the above described step S110 to acquire the corresponding tape color information and ink color information.

Then, in step S130, the CPU 102 outputs a control signal to the display part 104 and displays the tape color information and ink color information acquired in the above described step S120 on an edit screen of the display part 104. This process then terminates here.

Note that the present disclosure is not limited to the above described embodiment, and various modifications may be made without deviating from the spirit and scope of the disclosure. The following describes these modifications one by one. Note that components identical to those in the above described embodiment are denoted using the same reference numerals, and descriptions thereof will be omitted or simplified as appropriate.

(1) when a Color that does not Exist in the Color Correlations is Detected and Replaced with a Similar Color While the tape color of the print-receiving tape 57 and the ink color of the ink ribbon 60 of the tape cartridge 30 are acquired based on a detection result of the cartridge sensor 32 in the above described embodiment, the present disclosure is not limited thereto. That is, the tape color of the print-receiving tape 57 and the ink color of the ink ribbon 60 may be directly detected using a suitable known technique such as optical detection or image analysis. In such a case, the detected tape color and ink color may be colors that do not exist in the color correlations S prepared in advance. According to this modification, in such a case, the corresponding tape color ID and ink color ID are determined by replacing the detected colors with similar colors within the color correlations S. FIG. 10A and FIG. 10B respectively show the control procedures executed by the CPU 74 of the label producing apparatus 1 and the CPU 102 of the operation terminal 100 in order to achieve such a technique of this modification.

Control Procedure of Label Producing Apparatus

First, the control procedure executed by the CPU 74 of the label producing apparatus 1 will be described using FIG. 10A. The flow shown in FIG. 10A differs in that step S10 and step S20 of FIG. 9A are replaced with new steps S5 and S15, and step S50 and step S60 are newly disposed.

Figure 10A:
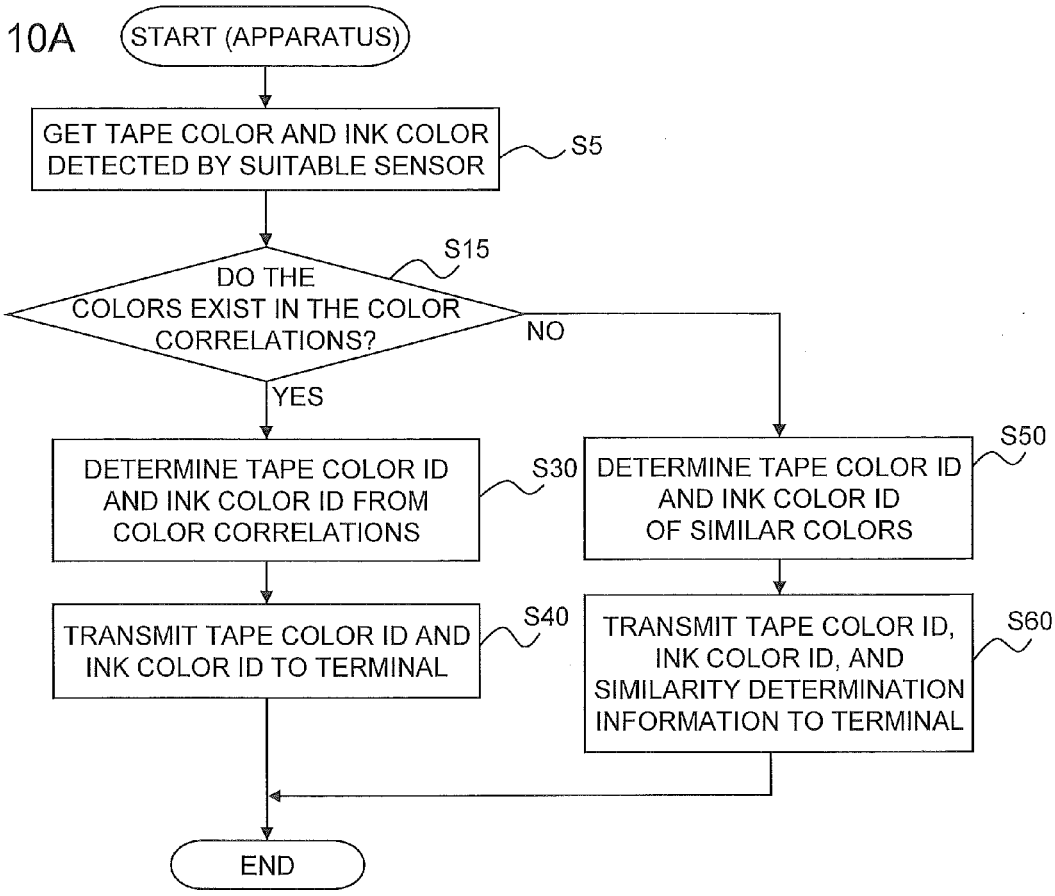
FIG. 10A is a flowchart showing the control procedure executed by the CPU of the label producing apparatus in a modification wherein a color that does not exist in the color correlations is replaced with a similar color at the time of detection.
Figure 10B:
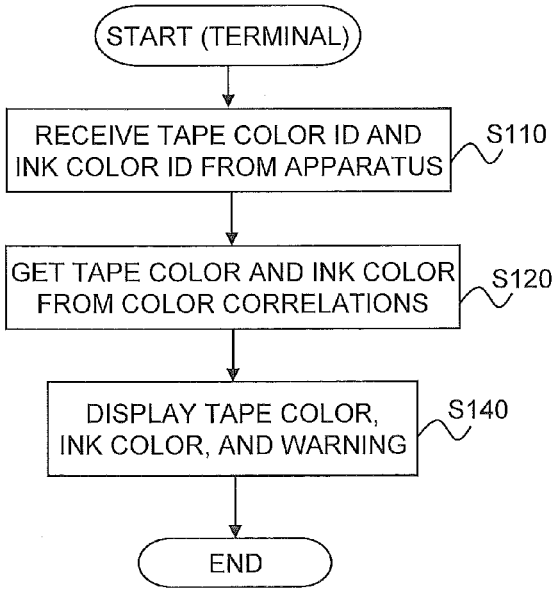
FIG. 10B is a flowchart showing the control procedure executed by the CPU of the operation terminal in the modification wherein a color that does not exist in the color correlations is replaced with a similar color at the time of detection.

That is, in FIG. 10A, first, in the newly disposed step S5, the CPU 74 acquires the tape color information and the ink color information of the tape cartridge 30 detected by the above described known technique of a suitable sensor, for the tape cartridge 30 mounted to the cartridge holder 8. As an example, an ultra-small camera is attached to the cartridge holder 8, for example, making it possible to directly acquire the above described tape color information and ink color information by taking an image of the print-receiving tape 57 and the ink ribbon 60. According to this modification, the CPU 74 that executes this step S5 functions as the color information acquiring portion described in the claims. When step S5 ends, the flow proceeds to the newly disposed step S15.

In step S15, the CPU 74 determines if the tape color and the ink color acquired in the above described step S5 are colors that exist in the aforementioned color correlations S stored in the EEPROM 77. If the tape color and ink color acquired in step S5 are colors that exist in the aforementioned color correlations S, the condition is satisfied (step S15: Yes) and the flow proceeds to step S30. The processing of step S30 and step S40 is the same as that in the above described FIG. 9A, and the description thereof is omitted. On the other hand, if the tape color acquired in step S5 is orange, for example, or the ink color is gray, for example, or the like, these colors do not exist in the aforementioned color correlations S and therefore the condition is not satisfied (step S15: No), and the flow proceeds to the newly disposed step S50.

In step S50, the CPU 74 determines the tape color ID of a color similar to the tape color and an ink color ID of a color similar to the ink color acquired in the above described step S5 while referring to the aforementioned color correlations S, following a predetermined similarity range (both warm colors, both cold colors, and the like, for example). For example, if the tape color is orange, for example, as previously mentioned, the similar color yellow, for example, is selected and the corresponding above described tape color ID: 6 is determined (refer to FIG. 7). Similarly, if the ink color is gray, for example, as previously mentioned, the similar color black, for example, is selected and the corresponding above described tape color ID: 8 is determined (refer to FIG. 7). Note that, according to this modification, the CPU 74 that executes this step S50 and the above described step S30 functions as the color identification information determining portion described in the claims. When step S50 ends, the flow proceeds to the newly disposed step S60.

In step S60, the CPU 74 transmits the tape color ID and ink color ID determined in the above described step S50 to the operation terminal 100 along with information indicating that a determination based on similar colors has been made (similarity determination information). According to this modification, the CPU 74 that executes this step S60 and the above described step S40 functions as the transmitting portion described in the claims. This process then terminates here.

Control Procedure of Operation Terminal

The control procedure executed by the CPU 102 of the operation terminal 100 in this modification will now be described using FIG. 10B. The flow shown in FIG. 10B differs in that step S130 of FIG. 9B is replaced with a new step S140.

That is, in FIG. 10B, the processing of step S110 and step S120 is the same as that of FIG. 9B, and the description thereof is omitted. When the above described step S120 ends, the flow proceeds to the newly disposed step S140.

In step S140, the CPU 102 outputs a control signal to the display part 104 and displays on an edit screen of the display part 104 the tape color information, ink color information, and (if included in the content during the above describe acquisition) the above described similarity determination information (that is, warning information indicating that the acquired tape color information and ink color information are not colors that exist in the color correlations S, but rather similar colors) acquired in the above described step S120 and transmitted from the label producing apparatus 1 in the above described step S40 or the above described step S60. This process then terminates here.

(2) When a Warning Requiring Caution is Displayed When the Tape and Ink are Close in Color According to this modification, when the print-receiving tape 57 and the ink ribbon 60 are relatively close in color and will presumably be visually difficult to see at the time of print formation, a display urging operator caution (or verification just to be safe) is generated on the display part 104 of the operation terminal 100. FIG. 11A and FIG. 11B show the control procedures executed by the CPU 74 of the label producing apparatus 1 and the CPU 102 of the operation terminal 100 in order to achieve such a technique of this modification.

Control Procedure of Label Producing Apparatus

First, the control procedure executed by the CPU 74 of the label producing apparatus 1 will be described using FIG. 11A. The flow shown in FIG. 11A differs in that a new step S35 is disposed between step S30 and step S40 of FIG. 9A, and a new step S70 that branches from step S35 is disposed.

Figure 11A:
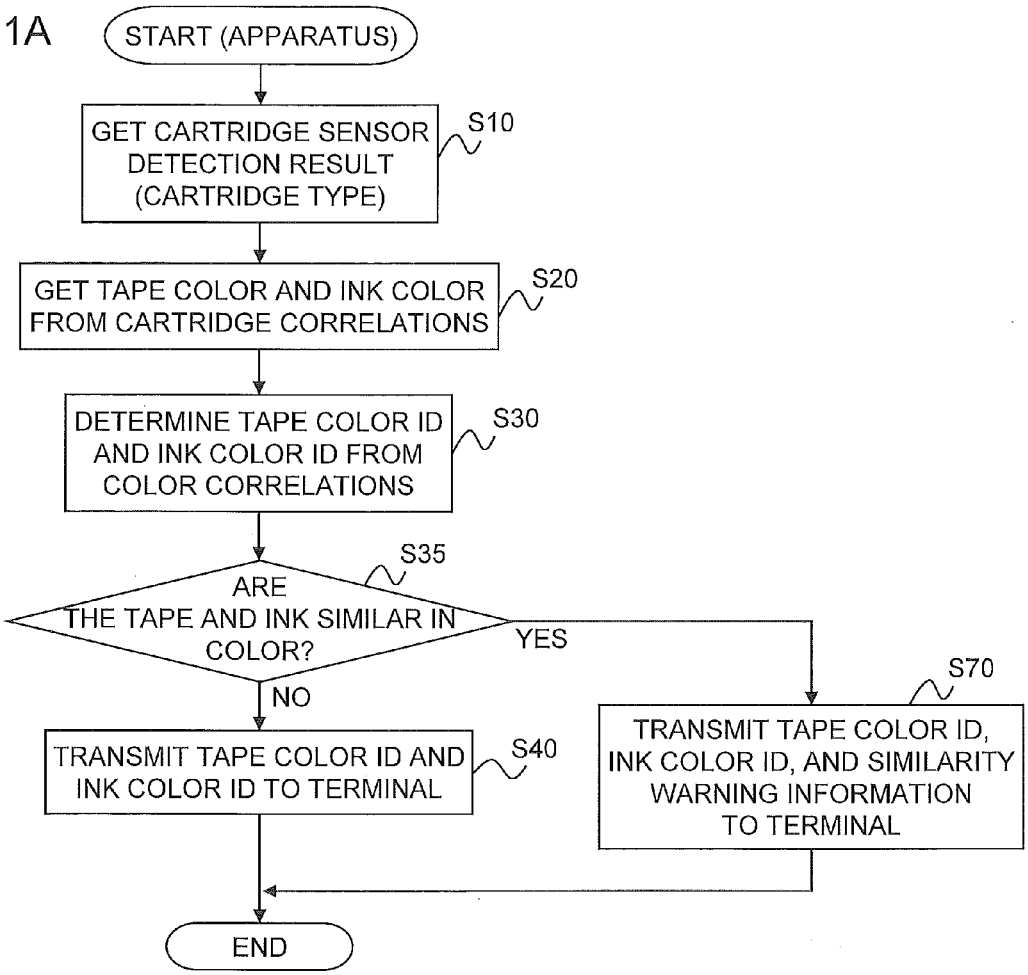
FIG. 11A is a flowchart showing the control procedure executed by the CPU of the label producing apparatus in a modification wherein a warning indicating that caution is required is displayed when the ink color is similar to the tape color.
Figure 11B:
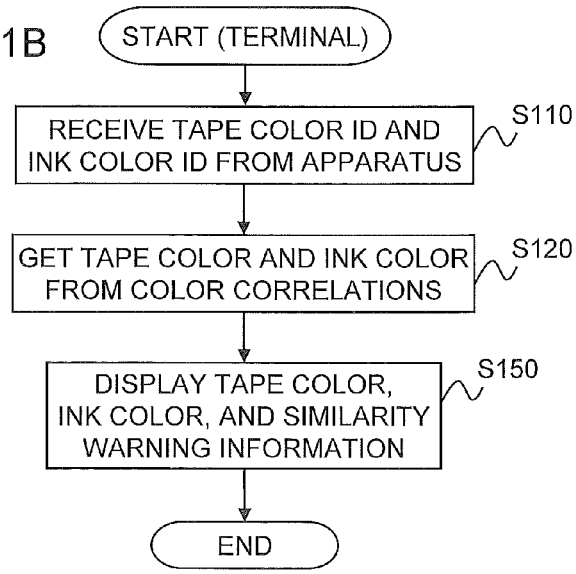
FIG. 11B is a flowchart showing the control procedure executed by the CPU of the operation terminal in the modification wherein a warning indicating that caution is required is displayed when the ink color is similar to the tape color.

In FIG. 11A, the processing of steps S10-S30 is the same as that of FIG. 9A, and the description thereof is omitted. When the above described step S30 ends, the flow proceeds to the newly disposed step S35.

In step S35, the CPU 74 determines whether or not the tape color and ink color acquired in the above described step S20 are mutually similar, based on the color similarity range determined in advance. If the tape color and ink color are not similar, the condition is satisfied (step S35: Yes), and the flow proceeds to step S40. The processing of step S40 is the same as that in the above described FIG. 9A, and the description thereof is omitted. On the other hand, in a case where the tape color and ink color are mutually similar (for example, in a case where the tape color is yellow and the ink color is red, the tape color is red and the ink color is yellow, or the like), the condition is not satisfied (step S35: No) and the flow proceeds to the newly disposed step S70. Note that the CPU 74 that executes this step S35 functions as the determining portion described in the claims.

In step S70, the CPU 74 transmits the tape color ID and ink color ID determined in the above described step S30 to the operation terminal 100 along with information indicating that the tape color and ink color are mutually similar (similarity warning information). According to this modification, the CPU 74 that executes this step S60 and the above described step S40 functions as the transmitting portion described in the claims. This process then terminates here.

Control Procedure of Operation Terminal

The control procedure executed by the CPU 102 of the operation terminal 100 in this modification will now be described using FIG. 11B. The flow shown in FIG. 11B differs in that step S130 of FIG. 9B is replaced with a new step S150.

In FIG. 11B, the processing of step S110 and step S120 is the same as that of FIG. 9B, and the description thereof is omitted. When the above described step S120 ends, the flow proceeds to the newly disposed step S150.

In step S150, the CPU 102 outputs a control signal to the display part 104 and displays on an edit screen of the display part 104 the tape color information, ink color information, and (if included in the content during the above describe acquisition) the above described similarity warning information (that is, warning information indicating that the tape color and ink color are mutually similar and will be visually difficult to see at the time of print formation) transmitted from the label producing apparatus 1 in the above described step S40 or the above described step S70 and acquired in the above described step S120. This process then terminates here.

Further, the arrows shown in the above described FIG. 4 denote an example of signal flow, but the signal flow direction is not limited thereto.

Also note that the present disclosure is not limited to the steps shown in the flowcharts of FIG. 9A, FIG. 9B, FIG. 10A, FIG. 10B, FIG. 11A, and FIG. 11B; step additions and deletions as well as sequence changes may be made without deviating from the spirit and scope of the disclosure.

Further, other than that already stated above, techniques based on the above described embodiment may be suitably utilized in combination as well.

Although other examples are not individually described herein, various changes can be made according to the present disclosure without deviating from the spirit and scope of the disclosure.

What is claimed is:

1. A printer comprising:

a cartridge holder configured to attach and detach a tape cartridge comprising a print-receiving tape roll that feeds out a print-receiving tape and an ink ribbon roll that feeds out an ink ribbon;

a thermal head configured to transfer ink of said ink ribbon fed out from said ink ribbon roll to, and perform printing on, said print-receiving tape fed out from said print-receiving tape roll of said tape cartridge mounted to said cartridge holder;

a first memory configured to store color correlations between a plurality of color types and a plurality of color identification information respectively associated with said plurality of color types, set in advance;

a color detecting portion configured to detect first color information of said print-receiving tape and second color information of said ink ribbon, of said tape cartridge mounted to said cartridge holder;

a color identification information determining portion configured to determine first color identification information of a color type corresponding to said first color information detected by said color detecting portion, and second color identification information of a color type corresponding to said second color information detected by said color detecting portion, by referring to said color correlations stored in said first memory; and a transmitting portion configured to transmit said first color identification information and said second color identification information determined by said color identification information determining portion to an operation terminal for operating said printer, comprising substantially the same color correlations as said color correlations.

2. The printer according to claim 1, further comprising a second memory configured to store cartridge correlations that associate type information of said tape cartridge, and a combination of said first color information of said print-receiving tape and said second color information of said ink ribbon, of said tape cartridge, wherein:

said color detecting portion comprises:

a cartridge sensor configured to detect the type information of said tape cartridge mounted to said cartridge holder; and a color information acquiring portion configured to refer to said cartridge correlations stored in said second memory in response to a detection result of said cartridge sensor and acquire said first color information and said second color information corresponding to the detection result.

3. The printer according to claim 1, wherein:

said color identification information determining portion determines said first color identification information or said second color identification information of a color type similar to said first color information or said second color information, based on a color similarity range determined in advance, in a case where the color type corresponding to said first color information or said second color information detected by said color detecting portion does not exist in said color correlations stored in said first memory; and said transmitting portion transmits, in a case where said color identification information determining portion has determined said first color identification information or said second color identification information of the color type similar to said first color information or said second color information, similarity determination information indicating that the color identification information with the similar color type has been determined to said operation terminal along with said first color identification information and said second color identification information.

4. The printer according to claim 1, further comprising a determining portion configured to determine whether or not said first color identification information and said second color identification information determined by said color identification information determining portion are mutually similar on the basis of a color similarity range determined in advance, wherein:

said transmitting portion transmits, in a case where said determining portion has determined that said first color identification information and said second color identification information are mutually similar, similarity warning information indicating that a similarity has been determined by said determining portion to said operation terminal along with said first color identification information and said second color identification information.

5. A printing processing method executed by a printer comprising a thermal head configured to transfer ink of an ink ribbon fed out from an ink ribbon roll to, and perform printing on, a print-receiving tape fed out from a print-receiving tape roll of a tape cartridge mounted to a cartridge holder, and a first memory configured to store color correlations between a plurality of color types and a plurality of color identification information respectively associated with said plurality of color types, set in advance, comprising the steps of:

a color detecting step for detecting first color information of said print-receiving tape and second color information of said ink ribbon, of said tape cartridge mounted to said cartridge holder;

a color identification information determining step for determining first color identification information of a color type corresponding to said first color information detected in said color detecting step, and second color identification information of a color type corresponding to said second color information detected in said color detecting step, by referring to said color correlations stored in said first memory; and a transmitting step for transmitting said first color identification information and said second color identification information determined in said color identification information determining step to an operation terminal for operating said printer, comprising substantially the same color correlations as said color correlations.

6. A non-transitory computer-readable recording medium storing a printing processing program for executing steps on a computing device provided to a printer comprising a thermal head configured to transfer ink of an ink ribbon fed out from an ink ribbon roll to, and perform printing on, a print-receiving tape fed out from a print-receiving tape roll of a tape cartridge mounted to a cartridge holder, and a first memory configured to store color correlations between a plurality of color types and a plurality of color identification information respectively associated with said plurality of color types, set in advance, said steps comprising:

a color detecting step for detecting first color information of said print-receiving tape and second color information of said ink ribbon, of said tape cartridge mounted to said cartridge holder;

a color identification information determining step for determining first color identification information of a color type corresponding to said first color information detected in said color detecting step, and second color identification information of a color type corresponding to said second color information detected in said color detecting step, by referring to said color correlations stored in said first memory; and a transmitting step for transmitting said first color identification information and said second color identification information determined in said color identification information determining step to an operation terminal for operating said printer, comprising substantially the same color correlations as said color correlations.

* * * * *